US010981032B2

(12) United States Patent
Randleman et al.

(10) Patent No.: US 10,981,032 B2
(45) Date of Patent: Apr. 20, 2021

(54) MOBILE EXERCISE PLATFORM

(71) Applicants: Erica Randleman, Denver, CO (US); Troy Randleman, Denver, CO (US); Courtney Turner, Denver, CO (US)

(72) Inventors: Erica Randleman, Denver, CO (US); Troy Randleman, Denver, CO (US); Courtney Turner, Denver, CO (US)

( * ) Notice: Subject to any disclaimer, the term of this patent is extended or adjusted under 35 U.S.C. 154(b) by 5 days.

(21) Appl. No.: 16/214,702

(22) Filed: Dec. 10, 2018

(65) Prior Publication Data

US 2020/0179745 A1 Jun. 11, 2020

(51) Int. Cl.

| | |
|---|---|
| ***A63B 21/00*** | (2006.01) |
| ***A63B 21/04*** | (2006.01) |
| ***A63B 22/18*** | (2006.01) |
| ***A63B 21/05*** | (2006.01) |
| ***A63B 21/055*** | (2006.01) |

(52) U.S. Cl.

CPC ..... *A63B 21/4033* (2015.10); *A63B 21/0442* (2013.01); *A63B 21/05* (2013.01); *A63B 21/0552* (2013.01); *A63B 22/18* (2013.01)

(58) Field of Classification Search

CPC . A63B 21/0552; A63B 21/0442; A63B 22/18; A63B 21/4033–4034; A63B 21/05–08; A63B 6/00–025

See application file for complete search history.

(56) References Cited

U.S. PATENT DOCUMENTS

| | | | | | |
|---|---|---|---|---|---|
| 2,882,052 | A * | 4/1959 | Smith | A63B 5/10 | 482/31 |
| 3,497,217 | A * | 2/1970 | Feather | A63B 23/025 | 482/10 |
| 3,806,116 | A * | 4/1974 | Malmberg | A63B 22/14 | 482/147 |
| 4,341,380 | A * | 7/1982 | Sauder | A61H 1/0237 | 482/26 |
| 4,505,476 | A * | 3/1985 | Rubin | A63B 22/02 | 482/147 |
| 5,352,173 | A * | 10/1994 | McLaughlin | A63B 23/03575 | 482/121 |
| 5,480,369 | A | 1/1996 | Dudley | | |
| D375,985 | S | 11/1996 | Dailey et al. | | |
| 5,634,870 | A * | 6/1997 | Wilkinson | A63B 5/11 | 482/27 |
| 5,897,464 | A * | 4/1999 | Mcleod | A63B 23/08 | 482/132 |
| D482,748 | S | 11/2003 | Flynt | | |
| 6,916,276 | B1 | 6/2005 | Robinson | | |
| D610,638 | S | 2/2010 | Friess et al. | | |
| 7,931,570 | B2 | 4/2011 | Hoffman | | |
| 7,942,793 | B2 | 5/2011 | Mills et al. | | |

(Continued)

*Primary Examiner* — Andrew S Lo

(74) *Attorney, Agent, or Firm* — John A. Arsenault; Daniel M. Dubuisson

(57) ABSTRACT

A mobile exercise platform system having one or more top plates lengthwise oriented in a first longitudinal direction or a second longitudinal direction, and two or more spring bars directly fastened to the top plates and being lengthwise oriented in a transverse direction. A coupling mechanism joins two individual exercise platforms together to increase the modes of exercise that may be performed. Openings in the top plates and support rods fastened to the underside of top plates further increase the versatility of exercise modes.

18 Claims, 8 Drawing Sheets

(56) References Cited

U.S. PATENT DOCUMENTS

| | | | | |
|---|---|---|---|---|
| D695,367 | S | 12/2013 | Lovegrove et al. | |
| 8,678,985 | B2 | 3/2014 | Mattox | |
| 8,715,144 | B1 | 5/2014 | Friess et al. | |
| 2003/0148853 | A1* | 8/2003 | Alessandri | A63B 22/0025 482/5 |
| 2003/0158021 | A1 | 8/2003 | Prichard | |
| 2004/0002411 | A1 | 1/2004 | Jackson | |
| 2004/0235620 | A1* | 11/2004 | Barbafieri | A63B 5/08 482/31 |
| 2005/0164836 | A1* | 7/2005 | Harker | A63B 21/023 482/52 |
| 2007/0117697 | A1* | 5/2007 | Genua | A63B 22/18 482/146 |
| 2008/0194392 | A1* | 8/2008 | Langer | A63B 21/0004 482/146 |
| 2008/0228110 | A1* | 9/2008 | Berme | A63B 21/00196 600/595 |
| 2013/0095982 | A1* | 4/2013 | Chen | A63B 21/05 482/71 |
| 2013/0316885 | A1* | 11/2013 | Harwin | A63B 23/03541 482/142 |
| 2014/0031175 | A1* | 1/2014 | Peralo | A63B 23/0244 482/66 |
| 2014/0038797 | A1* | 2/2014 | Curry | A63B 21/023 482/142 |
| 2014/0051553 | A1 | 2/2014 | Hetzel | |
| 2014/0315694 | A1* | 10/2014 | Singh | A63B 21/4033 482/79 |
| 2016/0175654 | A1* | 6/2016 | Harwin | A63B 21/4047 482/142 |
| 2017/0072257 | A1* | 3/2017 | Licklider | A61H 1/005 |
| 2019/0070450 | A1* | 3/2019 | Henesey | A63B 21/4033 |
| 2019/0224031 | A1* | 7/2019 | Dunca | A63B 21/023 |

* cited by examiner

MOBILE EXERCISE PLATFORM

STATEMENT REGARDING FEDERALLY SPONSORED RESEARCH AND DEVELOPMENT

Not Applicable.

CROSS-REFERENCE TO RELATED APPLICATIONS

This application is related to and/or claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)). In addition, the present application is related to the "Related Applications," if any, listed below.

BACKGROUND OF DISCLOSURE

1. Field of Invention

The present invention generally relates to exercise devices and more specifically to multi-purpose mobile exercise platforms.

2. Description of Prior Art

Exercise platforms provide a means for individual users to perform exercise routines of various types. Several types of exercise platforms are known. U.S. Pat. No. 7,931,570 describes an exercise device having a level frame, a frame keyport sequence, a track, a resistance medium, a platform within the track having at least two wheels and movable within the track, at least one resistance medium connecting the platform to the frame, and a platform frame having keyport sequences and a top panel. U.S. Pat. No. 8,715,144 describes a portable exercise platform with longitudinal and latitudinal resistance mechanisms, each resistance mechanism being attached to a platform section and having a plurality of resistance bands. U.S. Pat. No. 8,894,551 describes a portable exercise machine for the lower body having a foot carriage mounted and slidable on tracks that are held together in parallel and resistance elements impeding the movement of the foot carriage along the track. The prior art describe devices that lack versatility when using resistance bands with an exercise platform. What is needed is a versatile device that does not require resistance bands to perform exercise motions and avoids the frustration and aggravation that arises with using and storing an exercise platform.

SUMMARY OF THE DISCLOSURE

The present invention provides an exercise platform and mobile exercise platform system for performing exercises allowing improved versatility of exercises to be performed. The exercise platform system may be further equipped with resistance bands, handle assemblies, and other accessories, if desired. In a preferred embodiment, the exercise platform comprises one or more top plates, two or more spring bars, each spring bar comprising two U-shaped end portions interconnected by an upper section, a lower section, and an inner volume sandwiched in between the upper section and the lower section, wherein each upper section is directly fastened to one or more of the top plates, and wherein each spring bar is positioned underneath and is lengthwise oriented in a transverse direction.

In a preferred embodiment, the mobile exercise platform comprises a bottom plate layer comprising one or more bottom plates, each bottom plate being lengthwise oriented in a first longitudinal direction or a second longitudinal direction, a top plate layer comprising one or more top plates, each top plate being lengthwise oriented in a first longitudinal direction or a second longitudinal direction, and a spring bar layer positioned between and fastened to the bottom plate layer and the top plate layer, the spring bar layer comprising a plurality of spring bars, each spring bar being lengthwise oriented in a transverse direction. In a further embodiment, each spring bar further comprises U-shaped end portions interconnected by an upper section, a lower section, and an inner volume, wherein each upper section is directly fastened to one or more of the top plates, and wherein each lower section is directly fastened to one or more of the lower plates.

In an embodiment, the top plate layer further comprises one or more reinforcement plates directly fastened to one or more the top plates adjacent to the spring bar layer. In a further embodiment, one or more of the reinforcement plates are cut thereby defining a matching top view profile with one or more of the top plates. In an embodiment, one or more top plates are cut thereby defining one or more top plate openings. In a further embodiment, one or more of the top plate openings are lengthwise oriented in the first longitudinal direction or the second longitudinal direction.

In a further embodiment, the top plate layer further comprises one or more rods fastened to one or more of the reinforcement plates adjacent to the spring bar layer, wherein one or more of the rods are lengthwise oriented in the transverse direction. In a further embodiment, the mobile exercise platform system further comprises a resistance band assembly, wherein the resistance band assembly comprises a fastener, a resistance band, an adjuster, and a resistance band handle, wherein the fastener is adapted to reversibly fasten to any one of the rods through any one of the top plate openings.

In an embodiment, the adjuster takes a form of an O-shaped member wherein a rounded guidepath leads the resistance band therethrough, and wherein a protrusion on the resistance band is insertable into an indentation positioned along the rounded guidepath. In an embodiment, the adjuster takes a form of a cylindrical shaped member having one or more guide notches therein for leading the resistance band therethrough, and a clip externally positioned adjacent with respect to the cylindrical shaped member secured in place with the clip.

In an embodiment, the mobile exercise platform comprises a coupling mechanism for securing two individual exercise platforms together. In an embodiment, the coupling mechanism comprises two or more drop pins, wherein two of the spring bars are proximal spring bars and are drilled thereby defining spring bar drop pin ports for receiving the drop pins, and wherein two of the top plates are drilled thereby defining top plate drop pin ports for receiving the drop pins. In an embodiment, the coupling mechanism comprises two or more hinges securely fastened to and interconnecting two proximal spring bars, wherein the two proximal spring bars are adjacently positioned to each other. In a further embodiment, the mobile exercise platform system further comprises a system handle secured with one or more of the hinges for allowing a user to lift the mobile exercise platform system into a folded configuration. The exercise platform is generally flat and can be reversibly attached to a wall in a folded configuration for storage.

In an embodiment, the mobile exercise platform system further comprises one or more support pole assemblies, each support pole assembly being directly fastened to a top plate pole port or a support base that is insertable between two spring bars and between a top plate and a bottom plate. In a further embodiment, the support pole assembly comprises an upper pole, a lower pole, a grip handle directly attached to the upper pole, and a collar interconnecting the upper pole and the lower pole.

Embodiments include one, more, or any combination of all of the features listed above. Other features and advantages of the present invention will become apparent from the following more detailed description, taken in conjunction with the accompanying figures, which illustrate, by way of example, the principles of the invention.

Figure 1A:
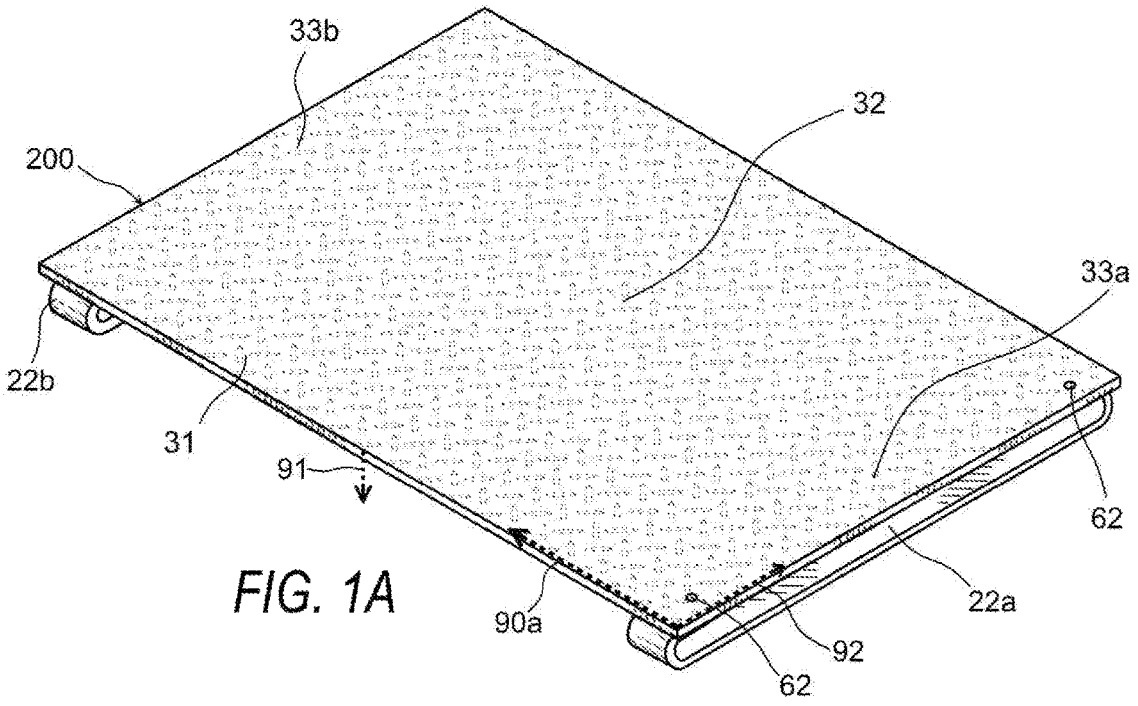
FIG. 1A is an elevated perspective view of an exercise platform, in accordance with an exemplary embodiment of the present invention.

REFERENCE NUMERALS IN THE DRAWINGS bottom plate layer 10
bottom plate 12
spring bar layer 20
spring bar 22
proximal spring bar 22*a*
distal spring bar 22*b*
spring bar upper section 26
spring bar lower section 27
spring bar front end portion 28*a*
spring bar rear end portion 28*b*
inner volume 29
top plate layer 30
top plate 31
top plate center portion 32
proximal longitudinal end portion 33*a*
distal longitudinal end portion 33*b*
top plate opening 34
rod 35
hinge 52
hinge bend 53
system handle 54
coupling mechanism 60
drop pin 61
top plate drop pin port 62
spring bar drop pin port 63
reinforcement plate 72
support pole assembly 80
grip handle 81 upper pole 82
collar 83
lower pole 84
support pole base 85
handle pole port 86
top plate pole port 87*a*
spring bar pole port 87*b*
groove 88
first longitudinal direction 90*a*
second longitudinal direction 90*b*
downward direction 91
transverse direction 92
base surface 100
resistance band assembly 110
resistance band adjuster 111
resistance band handle 112
resistance band fastener 114
resistance band 115
resistance band clip 116
resistance band protrusion 117
adjuster indentation 118
adjuster guidepath 119
resistance band handle strap 120
guide 121
exercise platform 200

DETAILED DESCRIPTION OF THE DISCLOSED EMBODIMENT

Illustrative embodiments of the invention are described below in the accompanying Figures. The following detailed description provides detailed schematics for a thorough understanding of and an enabling description for these embodiments. One having ordinary skill in the art will understand that the invention may be practiced without certain details. In other instances, well-known structures and functions have not been shown or described in detail to avoid unnecessarily obscuring the description of the embodiments.

Figure 1B:
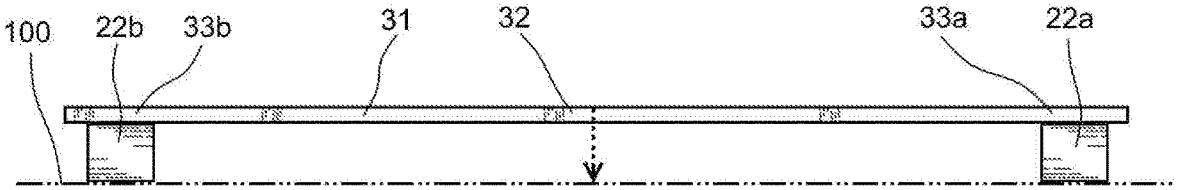
FIG. 1B is a front view of the exercise platform shown in FIG. 1A, in accordance with an exemplary embodiment of the present invention.
Figure 1C:
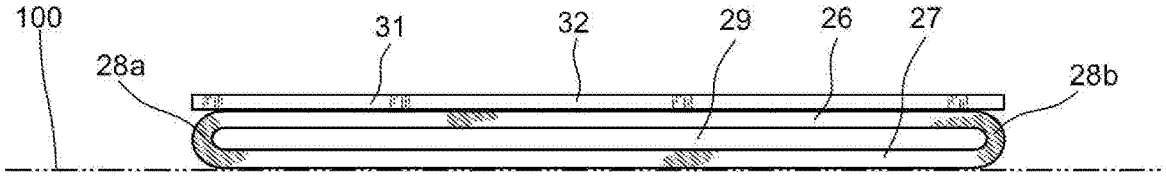
FIG. 1C is a right side view of the exercise platform shown in FIG. 1A, in accordance with an exemplary embodiment of the present invention.

FIG. 1A is an elevated perspective view of an exercise platform 200, in accordance with an exemplary embodiment of the present invention. FIG. 1B is a front view of the exercise platform 200 shown in FIG. 1A, in accordance with an exemplary embodiment of the present invention. FIG. 1C is a right side view of the exercise platform 200 shown in FIG. 1A, in accordance with an exemplary embodiment of the present invention. In this example embodiment, the exercise platform 200 comprises a top plate 31 and two spring bars 22*a*, 22*b*, end portion 33*a* and a distal longitudinal end portion 33*b* in a first longitudinal direction 90*a*, and wherein the spring bars 22*a*, 22*b* are fastened directly to the top plate 31 and positioned in a downward direction 91 with respect to the top plate 31. The proximal spring bar 22*a* is fastened adjacent to the proximal longitudinal end portion 33*a* of the top plate 31, and the distal spring bar 22*b* is fastened adjacent to the distal longitudinal end portion 33*b* of the top plate 31, and both spring bars 22*a*, 22*b* are lengthwise oriented in a transverse direction 92 with respect to the top plate 31. During operation, the exercise platform 200 generally rests upon a base surface 100 and a user steps onto the top plate 31 at a desired location thereby pressing the top plate 31 in a downward direction 91 towards the base surface 100 to an extent that depends on the position of the step in the first longitudinal direction 90*a*, the position of the step in the transverse direction 92, and the materials used to construct the top plate 31 and the various portions of the spring bars 22*a*, 22*b*. When the force of the step taken by the user is removed, the exercise platform 200 is biased to return to the original state shown in FIGS. 1A, 1B, and 1C by the spring bars 22*a*, 22*b* and the materials used to manufacture the various components of the exercise platform 200.

Figure 2A:
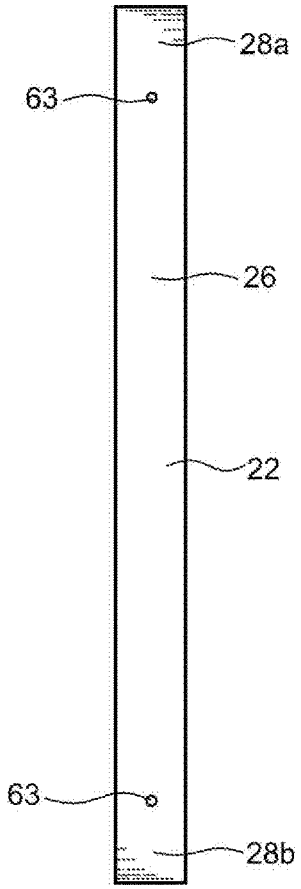
FIG. 2A is a top view of a spring bar, in accordance with an exemplary embodiment of the present invention.
Figure 2B:
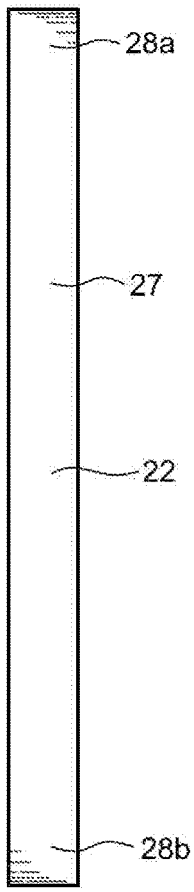
FIG. 2B is a bottom view of the spring bar shown in FIG. 2A, in accordance with an exemplary embodiment of the present invention.
Figure 2C:
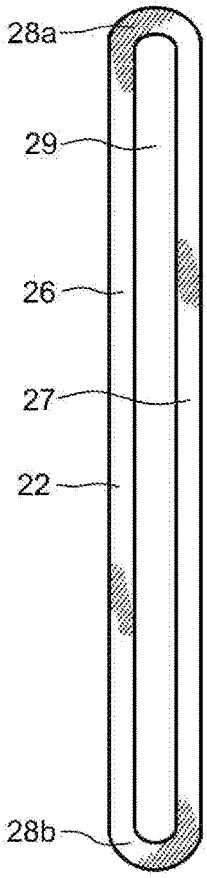
FIG. 2C is a right side view of the spring bar shown in FIG. 2A, in accordance with an exemplary embodiment of the present invention.
Figure 2D:
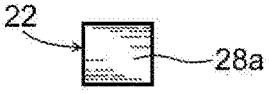
FIG. 2D is a front view of the spring bar shown in FIG. 2A, in accordance with an exemplary embodiment of the present invention.

FIG. 2A is a top view of a spring bar 22, in accordance with an exemplary embodiment of the present invention. FIG. 2B is a bottom view of the spring bar 22 shown in FIG. 2A, in accordance with an exemplary embodiment of the present invention. FIG. 2C is a right side view of the spring bar 22 shown in FIG. 2A, in accordance with an exemplary embodiment of the present invention. FIG. 2D is a front view of the spring bar 22 shown in FIG. 2A, in accordance with an exemplary embodiment of the present invention. Each spring bar 22 has front and rear U-shaped end portions 28*a*, 28*b* at opposing longitudinal ends interconnected by an upper section 26, a lower section 27, and an inner volume 29 sandwiched in between the upper section 26 and the lower section 27. The upper section 26 of each spring bar 22 directly fastens to the underside of one or more top plates 31.

The top plate 31 and spring bars 22 are generally comprised of a lightweight material that may be varied to increase the versatility of exercise modes. The lightweight materials may include, but are not limited to, steels and other iron alloys, aluminum alloy, copper alloy, polymeric materials or environmentally friendly materials such as recyclable materials. In an embodiment, the inner volume 29 comprises a material substantially identical to one or more spring bars 22.

Figure 3:
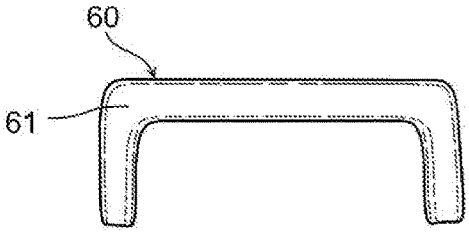
FIG. 3 is a front view of a drop pin, in accordance with an exemplary embodiment of the present invention.

FIG. 3 is a front view of a drop pin 61, in accordance with an exemplary embodiment of the present invention. In embodiments wherein a coupling mechanism 60 for securing two individual exercise platforms 200 together is in the form of a drop pin 61, the proximal spring bar 22*a* further comprises two or more drop pin ports 24 positioned on the upper section 26 and adapted to receive a drop pin 61, and the top plate 31 further comprises two or more drop pin ports 62 adjacent to the proximal longitudinal end portion 33*a* and adapted to receive the drop pin 61. Each peg of the drop pin 61 inserts into the top plate drop pin port 62 and through the proximal spring bar drop pin port 63 and is generally secured in place by mechanical friction.

Figure 4:
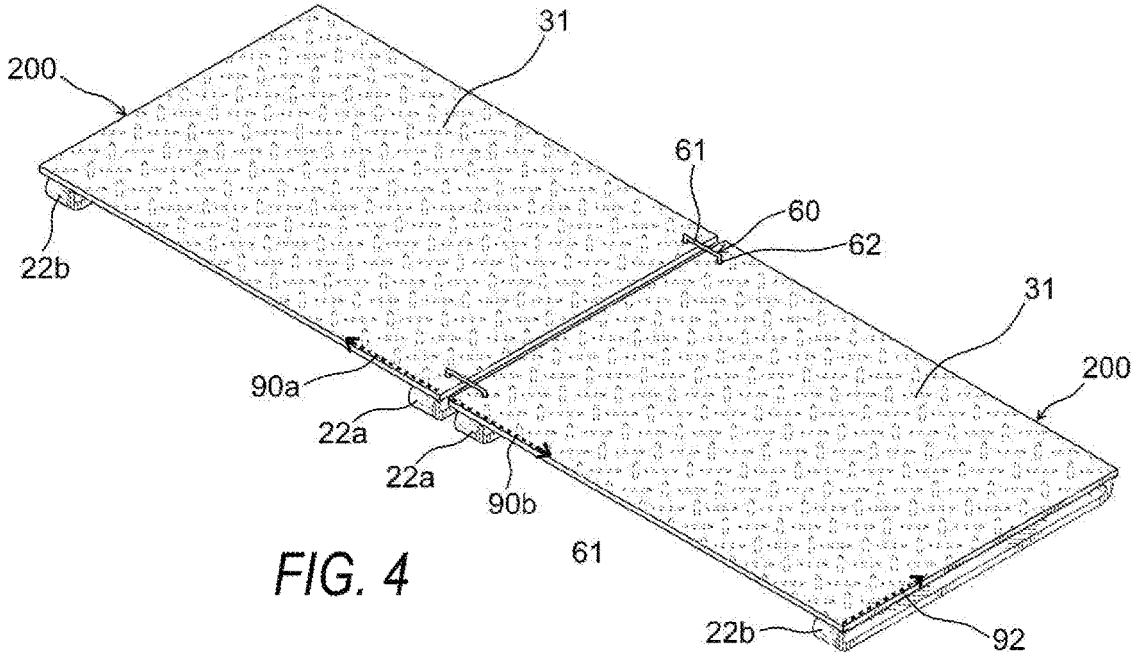
FIG. 4 is an exercise platform system with a coupling mechanism in the form of drop pins inserted into the top plate drop pin ports and proximal spring bar drop pin ports, in accordance with an exemplary embodiment of the present invention.

FIG. 4 is an exercise platform system with a coupling mechanism 60 in the form of drop pins 61 inserted into the top plate drop pin ports 62 and proximal spring bar drop pin ports 63, in accordance with an exemplary embodiment of the present invention. In this embodiment, the proximal spring bar 22*a* from each of two individual exercise platforms 200 has two or more drop pin ports 63 positioned on the upper section 26 for receiving drop pins 61. The drop pins 61 may be used to reversibly interconnect and maintain positions of adjacent top plates 31 and spring bars 22 prior to and during use by sliding into the drop pin ports 63. Removal of the drop pins 61 allows a user to decouple the two individual exercise platforms 200 of the system for storage and transport. An exercise platform system such as the example embodiment shown in FIG. 4 allows a user to step on separate exercise platforms 200 with each foot at desired locations on each top plate 31.

Figure 5:
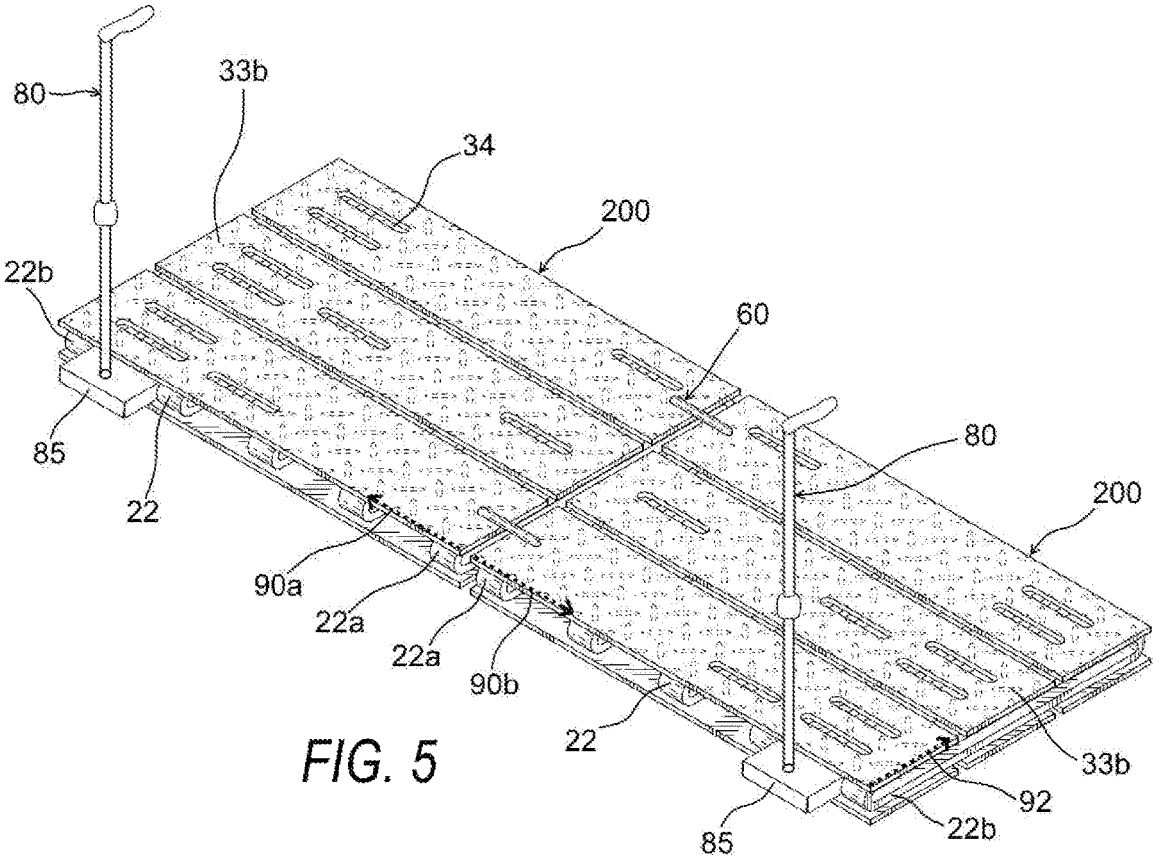
FIG. 5 is a perspective view of an exercise platform system equipped with two support pole assemblies and having a coupling mechanism in the form of drop pins inserted ports on the top plates and proximal spring bars, in accordance with an exemplary embodiment of the present invention.

FIG. 5 is a perspective view of an exercise platform system equipped with two support pole assemblies 80 and having a coupling mechanism 60 in the form of drop pins 61 inserted ports on the top plates 31 and proximal spring bars 22*a*, in accordance with an exemplary embodiment of the present invention. In this example embodiment, the exercise platform 200 comprises a bottom plate layer 10 having a plurality of bottom plates 12, a top plate layer 30 having a plurality of top plates 31, and a spring bar layer 20 sandwiched between the bottom plate layer 10 and the top plate layer 30 and having a plurality of spring bars 22, each spring bar 22 being lengthwise oriented transversely with respect to the top plates 31 and bottom plates 12.

In this example embodiment, two support pole assembly 80 for performing additional exercises has been installed and secured onto each of the two exercise platforms 200 of the exercise platform system adjacent to each distal longitudinal end portion 33*b*.

In this example embodiment, the top plates 31 further comprise top plate openings 34 that further increase the versatility of exercise modes that may be performed by a user by changing the extent of biasing of the top plates 31 adjacent to the top plate openings 34.

Figure 6:
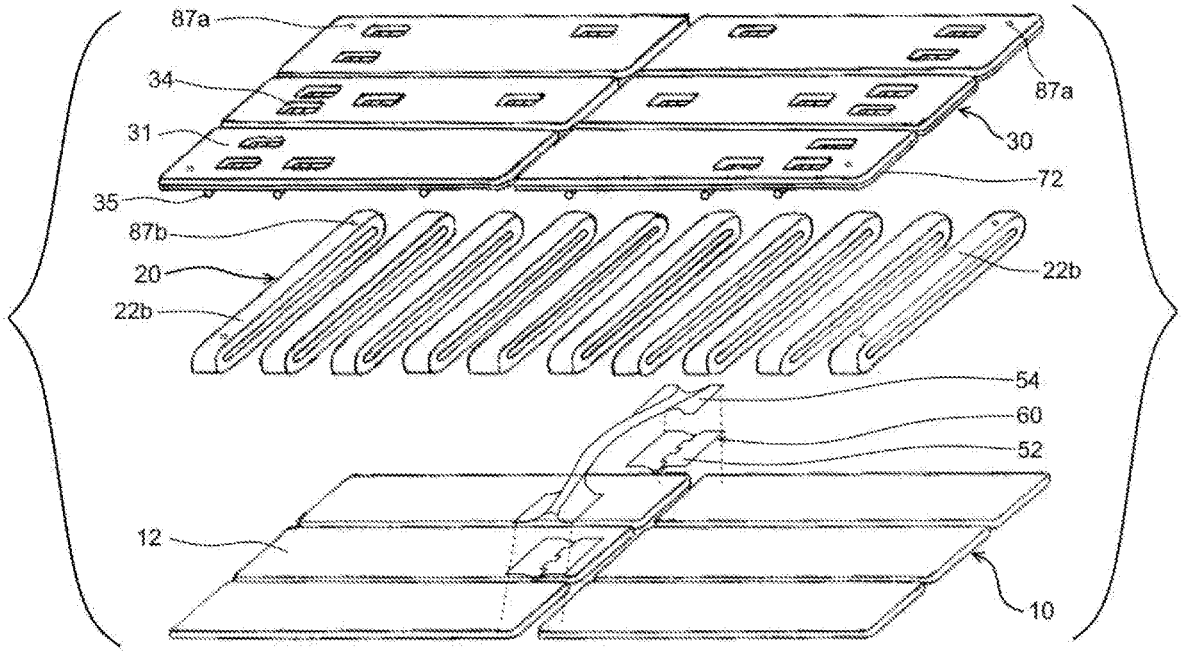
FIG. 6 is an exploded perspective view of a exercise platform system, in accordance with an exemplary embodiment of the present invention.

FIG. 6 is an exploded perspective view of a exercise platform system, in accordance with an exemplary embodiment of the present invention. In this example embodiment, the coupling mechanism 60 is in the form of hinges 52 directly fastened between each proximal spring bar 22*a* and the bottom plates 12. In an embodiment, the coupling mechanism 60 further comprises a system handle 54 for lifting and folding the exercise platform system for storage and transport. In an embodiment, the top plate layer 30 further comprises a plurality of reinforcement plates 72 directly fastened to the underside of one or more top plates 31 and being comprised of a strong material, which may include, but is not limited to, carbon steel, stainless steel, iron alloys, or aluminum alloys. The reinforcement plates 72 provide structural support to the top plates 31 are typically cut to match the top view profile of the corresponding top plates 31 and top plate openings 34.

In an embodiment, the top plate layer 30 further comprises a plurality of rods 35 that are directly fastened to the underside of the reinforcement plates 72 or the underside of the top plate 31, typically by welding, and are centered under the top plate openings 34. The rods 35 further reinforce the areas of the top plate 31 that are adjacent to the top plate openings 34 as well as further increase the versatility of exercise modes that a user can perform using the exercise platforms 200 and system of exercise platforms.

In an embodiment, the exercise platform system further comprises one or more platform pole ports 87*a*, 87*b* each adapted to receive and secure a lower pole 84 of a support pole assembly 80, wherein the top plate 31 further comprises one or more top plate pole ports 87*a* and the distal spring bar 22*b* further comprises one or more spring bar pole ports 87*b*.

Figure 7A:
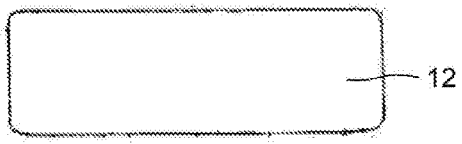
FIG. 7A is a top view of a bottom plate, in accordance with an exemplary embodiment of the present invention.
Figure 7B:
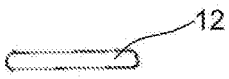
FIG. 7B is a side view of a bottom plate, in accordance with an exemplary embodiment of the present invention.
Figure 7C:
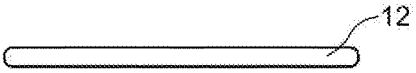
FIG. 7C is a front view of a bottom plate, in accordance with an exemplary embodiment of the present invention.

FIG. 7A is a top view of a bottom plate 12, in accordance with an exemplary embodiment of the present invention. FIG. 7B is a side view of a bottom plate 12, in accordance with an exemplary embodiment of the present invention. FIG. 7C is a front view of a bottom plate 12, in accordance with an exemplary embodiment of the present invention. The bottom plates 12 reinforce the positions and orientations of the spring bars 22 relative to the top plates 31.

Figure 8A:
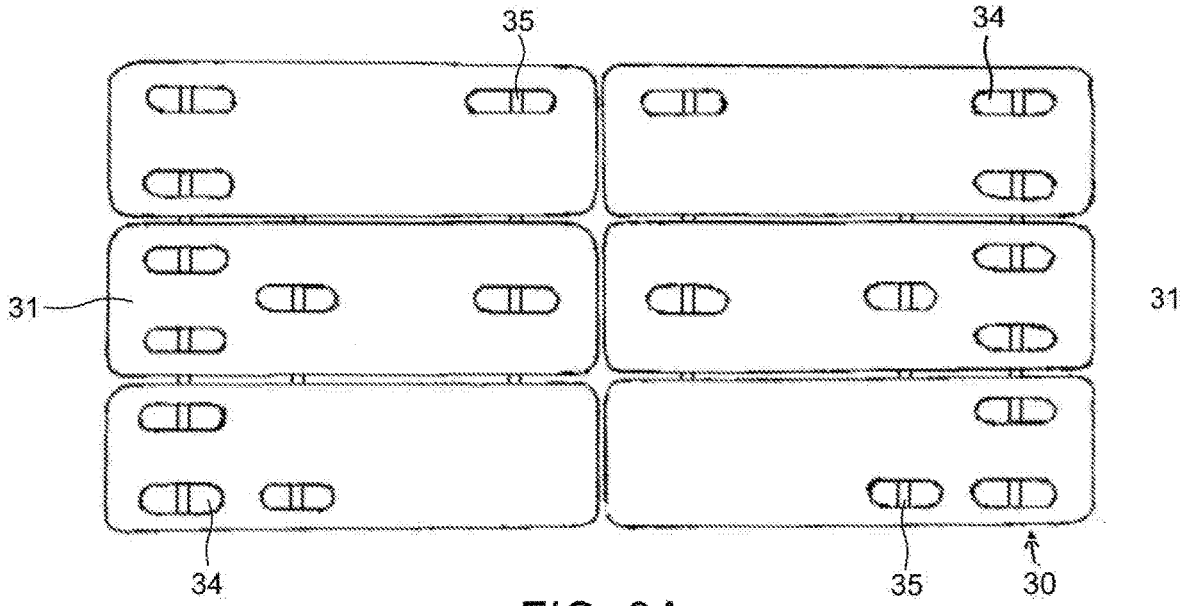
FIG. 8A is a top view of a top plate layer, in accordance with an exemplary embodiment of the present invention.
Figure 8B:
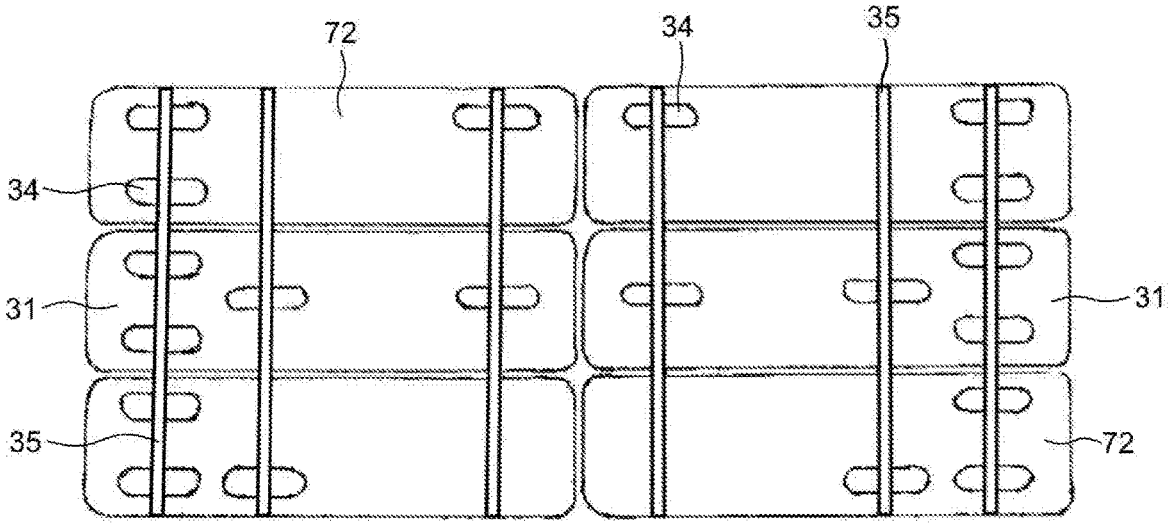
FIG. 8B is a bottom view of a top plate layer, in accordance with an exemplary embodiment of the present invention.

FIG. 8A is a top view of a top plate layer 30, in accordance with an exemplary embodiment of the present invention. FIG. 8B is a bottom view of a top plate layer 30, in accordance with an exemplary embodiment of the present invention. In this example embodiment, the top plate layer 30 comprises a plurality of top plates 31 aligned flat and mirrored in the longitudinal directions 90*a*, 90*b*. The top plate layer 30 is where a user steps up to or stands to perform exercise.

Figure 9:
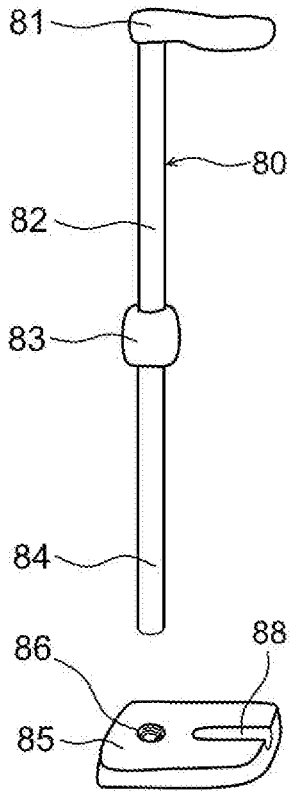
FIG. 9 is the support pole assembly and the support pole base shown in FIG. 5, in accordance with an exemplary embodiment of the present invention.

FIG. 9 is the support pole assembly 80 and the support pole base 85 shown in FIG. 5, in accordance with an exemplary embodiment of the present invention. In this example embodiment, the support pole assembly 80 comprises an upper pole 82, a lower pole 84, a grip handle 81 directly attached the upper end portion of the upper pole 82, a collar 83 interconnecting a lower end portion of the upper pole 82 and the upper end portion of the lower pole 84. The lower end portion of the lower pole 84 inserts into and reversibly attaches with either the base pole port 86 or any of the top plate pole ports 87*a* and corresponding spring bar pole ports 87*b*. In the example embodiment shown in FIG. 5, the support pole base 85 slides between the top plates 31 and bottom plates 12 of the platform and between two spring bars 22 and is secured to the top plates 31 from underneath. A groove 88 on the support pole base 85 is adapted to receive a rod 35 of the top plate layer 10 thereby further securing the support pole base 85 to the exercise platform system. The collar 83 is rotatable about the axis of the upper pole 82 and lower pole 84, whereby rotation of the collar 84 tightens or loosens the for adjusting the support pole assembly 80 to accommodate users of various heights. This example embodiment improves stabilization of the exercise platform system during exercises, if desired, and is particularly useful for performing several types of leg exercises.

Figure 10:
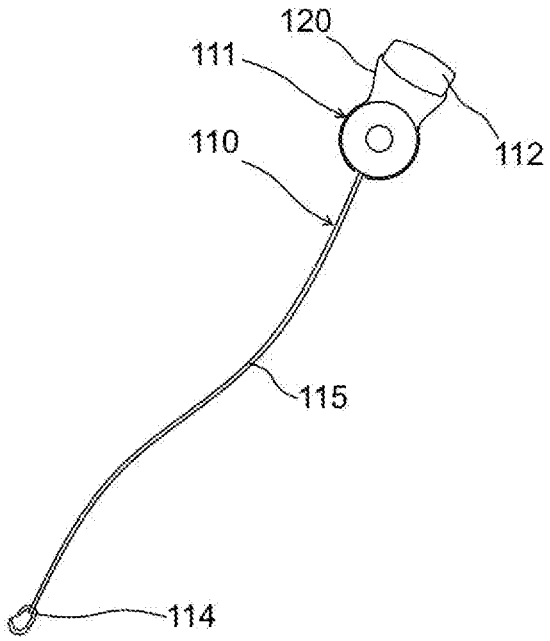
FIG. 10 is a perspective view of a resistance band assembly, in accordance with an exemplary embodiment of the present invention.

FIG. 10 is a perspective view of a resistance band assembly 110, in accordance with an exemplary embodiment of the present invention. In embodiments, the exercise platform system may further comprise one or more resistance band assemblies 110, wherein each resistance band assembly 110 comprises a resistance band 115 interconnecting a fastener 114 to an adjuster 111, a handle strap 120, and a resistance band handle 112. The adjuster 111 functions to change the effective length of the resistance bands to accommodate users of various heights.

Figure 11:
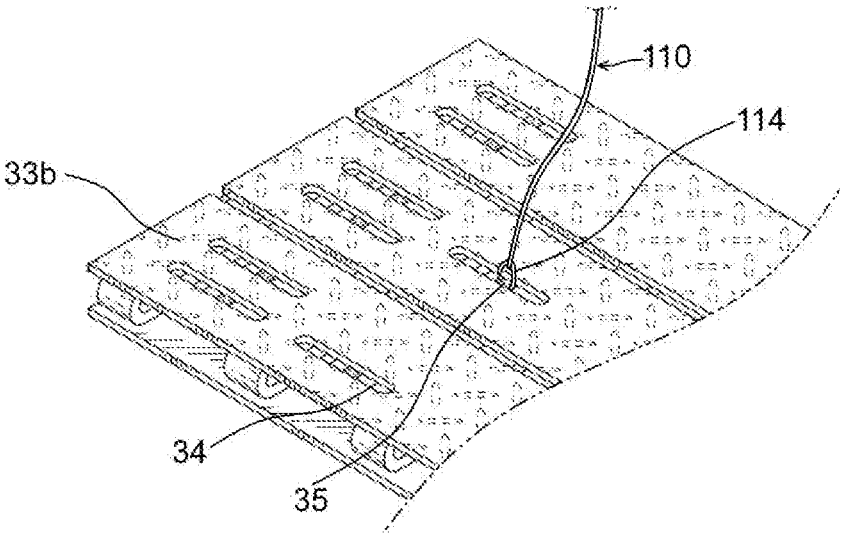
FIG. 11 is an elevated perspective view of a resistance band assembly fastened to a rod through a top plate opening, in accordance with an exemplary embodiment of the present invention.

FIG. 11 is an elevated perspective view of a resistance band assembly 110 fastened to a rod 35 through a top plate opening 34, in accordance with an exemplary embodiment of the present invention. The fastener 114 is adapted to reversibly fasten to any one of the rods 35 through any one of the top plate openings 34. If desired, a user can fasten and secure the resistance band assembly 110 to the rod 35 and perform exercises by holding onto the resistance band handle 112 and stretching the resistance band 115.

Figure 12:
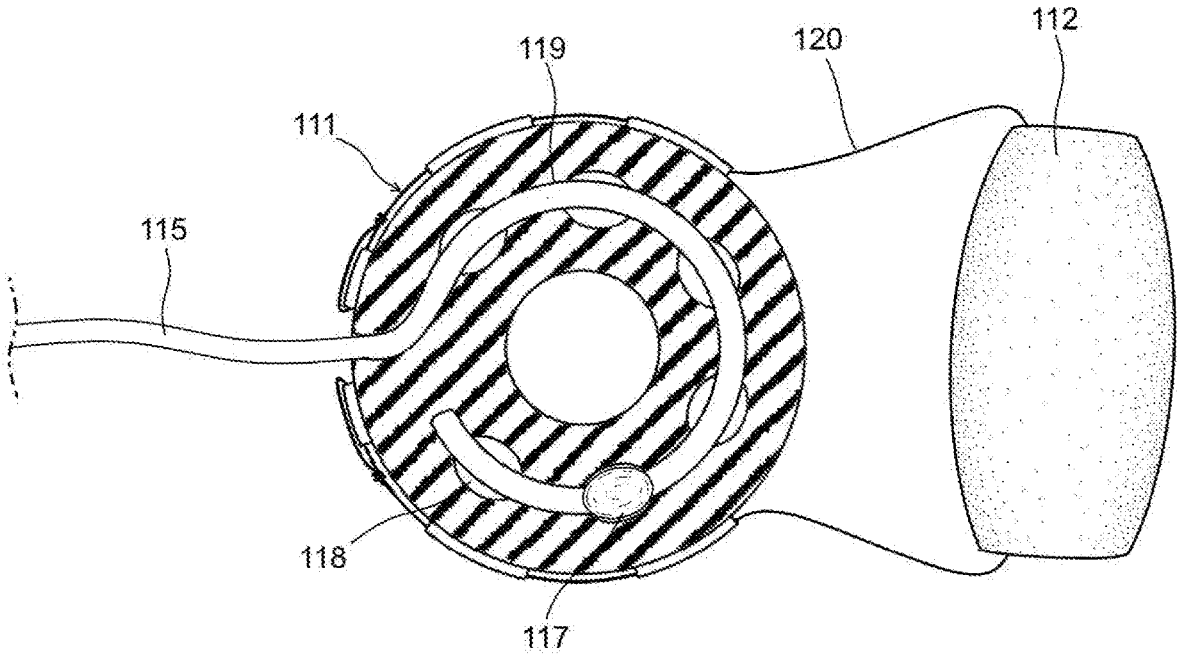
FIG. 12 is a cross-sectional side view of a resistance band adjuster, in accordance with an exemplary embodiment of the present invention.

FIG. 12 is a cross-sectional side view of a resistance band adjuster 111, in accordance with an exemplary embodiment of the present invention. In this example embodiment, the adjuster 111 takes the form of an O-shaped member wherein a rounded guidepath 119 leads the resistance band 115 therethrough, and a protrusion 117 near the terminal end of the resistance band 115 is insertable into one of several indentations 118 along the guidepath 119. The various indentations 118 provide an effective method to accommodate for various heights of the user.

Figure 13:
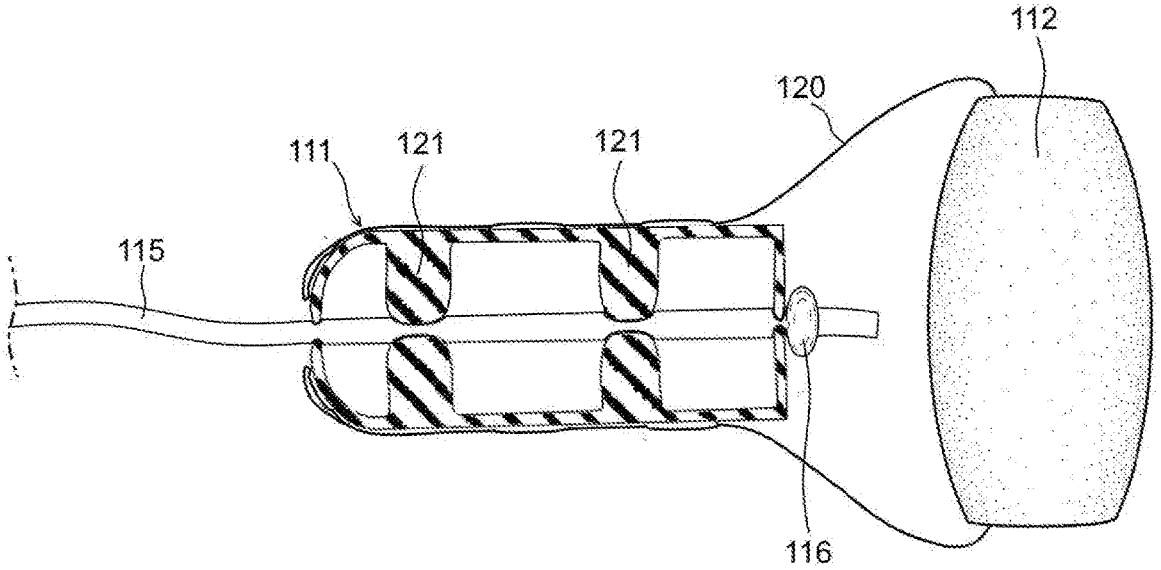
FIG. 13 is a cross-sectional side view of a resistance band adjuster, in accordance with an exemplary embodiment of the present invention.

FIG. 13 is a cross-sectional side view of a resistance band adjuster 111, in accordance with an exemplary embodiment of the present invention. In this example embodiment, the adjuster 111 takes the form of a cylindrical shaped member having guide notches 121 within to lead the resistance band 115 therethrough and a clip 116 externally positioned adjacent to the terminal end of the cylindrical shaped member. The resistance band 115 may be pulled through the cylindrical shaped member and secured in place with the clip 116, thus providing an effective method to accommodate for various heights of the user.

Figure 14A:
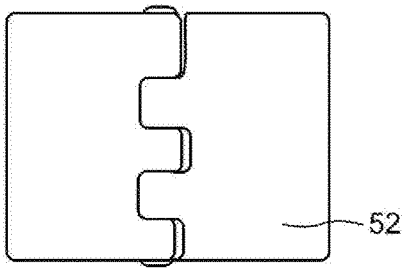
FIG. 14A is a top view of a coupling mechanism in the form of a hinge, in accordance with an exemplary embodiment of the present invention.
Figure 14B:
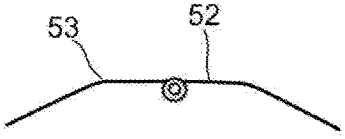
FIG. 14B is a side view of the hinge shown in FIG. 14A, in accordance with an exemplary embodiment of the present invention.

FIG. 14A is a top view of a coupling mechanism in the form of a hinge 52, in accordance with an exemplary embodiment of the present invention. FIG. 14B is a side view of the hinge 52 shown in FIG. 14A, in accordance with an exemplary embodiment of the present invention. The hinges 52 allow the example exercise platform system to be folded and stored or transported in a vertical orientation. Each hinge 52 may comprise a bend 53 on each opposing section of the hinge 52 to ensure proper closure of the exercise platform system for storage or transport. The hinge bends 53 have angles that are approximately 13 degrees to 23 degrees. It is contemplated that a coupling mechanism 60 in the form of a piano hinge may suffice for some exercise platform systems without deviating from the scope of the invention described herein.

Figure 15:
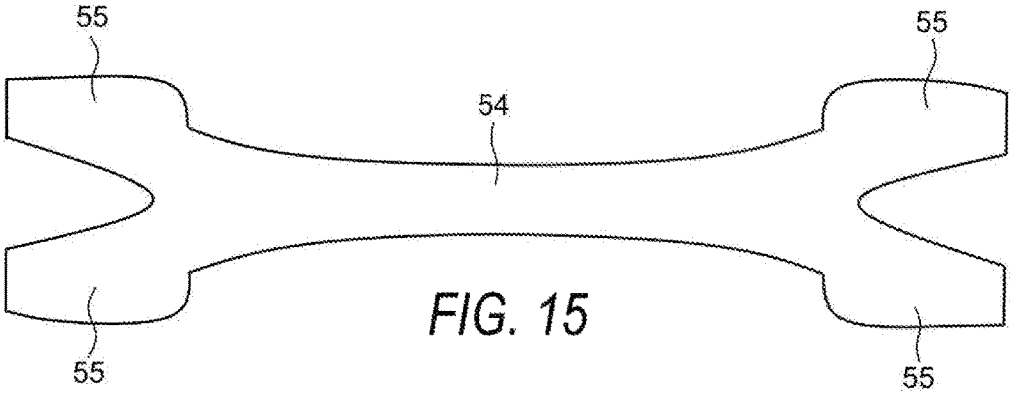
FIG. 15 is a top view of a system handle installed with the hinge, in accordance with an exemplary embodiment of the present invention.

FIG. 15 is a top view of a system handle 54 installed with the hinge 52, in accordance with an exemplary embodiment of the present invention. The system handle 54 has two or more handle end portions 55, wherein each handle end portion 55 is secured between a hinge 52 and bottom plate 12.

Figure 16A:
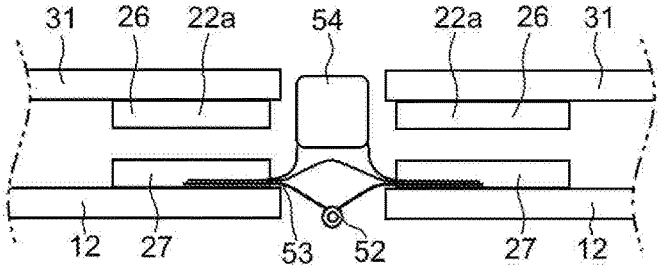
FIG. 16A is a cross-sectional view of the hinge shown in FIG. 14A attaching together two exercise platforms and in a flattened configuration, in accordance with an exemplary embodiment of the present invention.
Figure 16B:
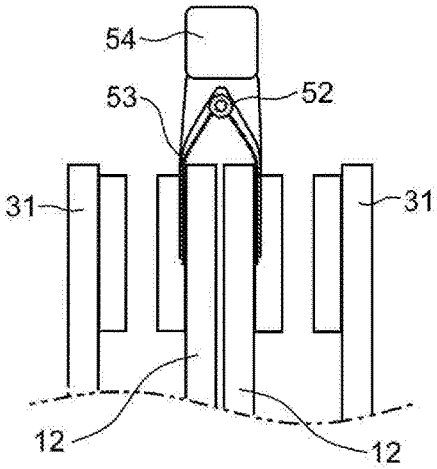
FIG. 16B is a cross-sectional view of the hinge shown in FIG. 14A attaching together two exercise platforms and in a folded configuration, in accordance with an exemplary embodiment of the present invention.

FIG. 16A is a cross-sectional view of the hinge 52 shown in FIG. 14A attaching together two exercise platforms 200 and in a flattened configuration, in accordance with an exemplary embodiment of the present invention. FIG. 16B is a cross-sectional view of the hinge 52 shown in FIG. 14A attaching together two exercise platforms 200 and in a folded configuration, in accordance with an exemplary embodiment of the present invention. In an embodiment, the coupling mechanism 60 comprises one or more hinges 52 each securely fit between a bottom plate 12 and the lower portion 27 of a proximal spring bar 22*a* of two adjacent exercise platforms 200. The system handle 54 is also secured with the hinge 52 between a bottom plate 12 and the lower portion 27 of a proximal spring bar 22*a* of two adjacent exercise platforms 200. In this example embodiment, a user can use the system handle 54 to lift the exercise platform system into a folded configuration for storage and transport.

While particular embodiments of the invention have been described and disclosed in the present application, it is clear that any number of permutations, modifications, or embodiments may be made without departing from the spirit and the scope of this invention. Accordingly, it is not the inventor's intention to limit this invention in this application, except as by the claims.

Particular terminology used when describing certain features or aspects of the invention should not be taken to imply that the terminology is being redefined herein to be restricted to any specific characteristics, features, or aspects of the invention with which that terminology is associated. In general, the terms used in the claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

In general, the terms used in the claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

In light of the above "Detailed Description," Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

We claim:

1. A mobile exercise platform system comprising:

a bottom plate layer comprising one or more bottom plates, each said bottom plate being lengthwise oriented in a first longitudinal direction or a second longitudinal direction;

a top plate layer comprising one or more top plates, each said top plate being lengthwise oriented in said first longitudinal direction or said second longitudinal direction;

a spring bar layer positioned between and fastened to said bottom plate layer and said top plate layer, said spring bar layer comprising a plurality of spring bars, each said spring bar being lengthwise oriented in a transverse direction, wherein each said spring bar further comprises U-shaped end portions interconnected by an upper section, a lower section, and an inner volume.

2. The mobile exercise platform system of claim 1, wherein each said upper section being directly fastened to one or more of said top plates, wherein each said lower section being directly fastened to one or more of said bottom plates.

3. The mobile exercise platform system of claim 1, further comprising two or more drop pins, wherein two of said spring bars are proximal spring bars and are drilled thereby defining spring bar drop pin ports for receiving said one or more drop pins, wherein two of said top plates are drilled thereby defining top plate drop pin ports for receiving said one or more drop pins.

4. The mobile exercise platform system of claim 1, wherein one or more top plates are cut thereby defining one or more top plate openings.

5. The mobile exercise platform system of claim 4, wherein one or more of said top plate openings are lengthwise oriented in said first longitudinal direction or said second longitudinal direction.

6. The mobile exercise platform system of claim 1, wherein said top plate layer further comprises one or more reinforcement plates directly fastened to one or more said top plates adjacent to said spring bar layer.

7. The mobile exercise platform system of claim 6, wherein said top plate layer further comprises one or more rods fastened to one or more of said reinforcement plates adjacent to said spring bar layer, wherein said one or more rods are lengthwise oriented in said transverse direction.

8. The mobile exercise platform system of claim 6, wherein one or more of said reinforcement plates are cut thereby defining a matching top view profile with one or more of said top plates.

9. The mobile exercise platform system of claim 1, wherein said top plates are comprised of a first material selected from the group consisting of iron alloys, aluminum alloys, copper alloys, polymeric materials, and recyclable materials.

10. The mobile exercise platform system of claim 1, wherein said spring bars are comprised of a second material selected from the group consisting of iron alloys, aluminum alloys, copper alloys, polymeric materials, and recyclable materials.

11. The mobile exercise platform of claim 6, wherein said reinforcement plates are comprised of a material selected from the group consisting of carbon steels, stainless steels, other iron alloys, and aluminum alloys.

12. The mobile exercise platform system of claim 1, further comprising two or more hinges securely fastened to and interconnecting two proximal spring bars, wherein said two proximal spring bars are adjacently positioned.

13. The mobile exercise platform system of claim 7, further comprising a resistance band assembly, wherein said resistance band assembly comprises a fastener, a resistance band, an adjuster, and a resistance band handle, wherein said fastener is adapted to reversibly fasten to any one of said rods through any one of said top plate openings.

14. The mobile exercise platform system of claim 13, wherein said adjuster takes a form of an O-shaped member wherein a rounded guidepath leads said resistance band therethrough, and wherein a protrusion on said resistance band is insertable into an indentation positioned along said rounded guidepath.

15. The mobile exercise platform system of claim 13, wherein said adjuster takes a form of a cylindrical shaped member having one or more guide notches therein for leading said resistance band therethrough, and a clip externally positioned adjacent with respect to said cylindrical shaped member secured in place with said clip.

16. The mobile exercise platform system of claim 12, further comprising a system handle secured with one or more of said hinges for allowing a user to lift the mobile exercise platform system into a folded configuration.

17. The mobile exercise platform system of claim 1, further comprising one or more support pole assemblies, each said support pole assembly directly fastened to a top plate pole port or a support base insertable therebetween two of said spring bars.

18. The mobile exercise platform system of claim 17, wherein said support pole assembly comprises:

an upper pole;

a lower pole;

a grip handle directly attached to said upper pole;

and a collar interconnecting said upper pole and said lower pole.

* * * * *